US010276928B2

(12) United States Patent
Mayer et al.

(10) Patent No.: US 10,276,928 B2
(45) Date of Patent: Apr. 30, 2019

(54) SENSOR DEVICE FOR A MOTOR VEHICLE

(71) Applicant: Robert Bosch GmbH, Stuttgart (DE)

(72) Inventors: Marcel Mayer, Leonberg (DE); Klaus Baur, Mietingen (DE); Thomas Schmidt, Backnang (DE); Johannes Meyer, Boeblingen (DE); Andreas Pietsch, Bietigheim-Bissingen (DE); Hartmut Kittel, Weissach-Flacht (DE); Maik Hansen, Leonberg (DE); Mehran Pourmousavi, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 180 days.

(21) Appl. No.: 15/208,773

(22) Filed: Jul. 13, 2016

(65) Prior Publication Data

US 2017/0018844 A1 Jan. 19, 2017

(30) Foreign Application Priority Data

Jul. 17, 2015 (DE) ..... 10 2015 213 553

(51) Int. Cl.
*H01Q 1/32* (2006.01)
*H01Q 21/06* (2006.01)

(52) U.S. Cl.
CPC ..... *H01Q 1/3283* (2013.01); *H01Q 21/061* (2013.01)

(58) Field of Classification Search
CPC .. H01Q 1/1271; H01Q 1/3275; H01Q 1/1278; H01Q 1/325
USPC ..... 343/713, 720, 878, 711
See application file for complete search history.

(56) References Cited

U.S. PATENT DOCUMENTS

2002/0163478 A1* 11/2002 Pleva ..... B60K 31/0008 343/853
2013/0321196 A1* 12/2013 Binzer ..... G01S 13/87 342/70

* cited by examiner

*Primary Examiner* — Dameon E Levi
*Assistant Examiner* — Collin Dawkins
(74) *Attorney, Agent, or Firm* — Norton Rose Fulbright US LLP; Gerard Messina

(57) ABSTRACT

A sensor device for a motor vehicle, including a first transmitting antenna, which is situated on a surface of a substrate, has a narrow lobe-type directional characteristic and includes a defined number of planar antenna elements; a second transmitting antenna situated on the surface of the substrate has a wide lobe-type directional characteristic, including a defined number of planar antenna elements, the directional characteristics of the two transmitting antennas being oriented opposite one another by a defined angle, with respect to a boresight; and at least one receiving antenna situated on the surface of the substrate including a defined number of planar antenna elements.

14 Claims, 5 Drawing Sheets

SENSOR DEVICE FOR A MOTOR VEHICLE

CROSS REFERENCE

The present application claims the benefit under 35 U.S.C. § 119 of German Patent Application No. DE 102015213553.5 filed on Jul. 17, 2015, which is expressly incorporated herein by reference in its entirety.

FIELD

The present invention relates to a sensor device for a motor vehicle. The present invention also relates to a method for manufacturing a sensor device for a motor vehicle.

BACKGROUND INFORMATION

Radar sensors in a frequency band from approximately 76 GHz to approximately 77 GHz are being used to an increasing extent in systems for detection of surroundings, in particular in motor vehicles which have modern driver assistance systems. Conventional sensor generations are used for the long-distance range (detection range up to approximately 250 m) including strongly focusing systems, the detected objects being detected only in a narrow angle range, for example, less than approximately ±30° with respect to the vehicle axis.

A plurality of novel functions, which are to be covered by future systems, require radar sensors having large aperture angles and thus a wide field of view. The aforementioned functions may include, for example, detection of crossing pedestrians/cyclists, intersection assistants, monitoring of a rearward area of the vehicle, monitoring of dead angles, etc.

Radar sensors are therefore installed at various locations in the vehicle, for example, in all four corners of the vehicle, in addition to the front sensors, which are already present. These sensors should implement different directions of emission in deviation from the sensor axis to achieve the greatest possible range and precision laterally in an angle range of approximately ±60°, for example. With today's sensor generations, the antennas are mostly situated in a planar arrangement on a circuit board. Such an arrangement is readily suitable for focusing the transmission/receiving power at a right angle to the circuit board.

Conventional automotive radar sensors have two transmitting antennas and four receiving antennas. More than one transmitting antenna must be used to implement different fields of view. With so-called corner sensors, which are installed in the two front corners of the vehicle, two identical weakly bundling antennas are used for a wide angular field of view in one detection direction. In contrast thereto, conventional so-called rear sensors, which are installed in the two rear corners of a vehicle, have two strongly bundling antennas, which implement a narrow field of view. It is a disadvantage that two different types of sensors, each having specific directional characteristics, are required for covering all four corners of the vehicle.

SUMMARY

One object of the present invention is to provide an improved sensor device for a motor vehicle.

According to a first aspect, this object may be achieve achieved with a sensor device for a motor vehicle, including

- a first transmitting antenna, which is situated on a surface of a substrate and has a narrow lobe-type directional characteristic, including a defined number of planar antenna elements;

- a second transmitting antenna, which is situated on the surface of the substrate and has a wide lobe-type directional characteristic, including a defined number of planar antenna elements, where the directional characteristics of the two transmitting antennas are directed opposite one another by a defined angle, with respect to a boresight; and
- at least one receiving antenna situated on the surface of the substrate and having a defined number of planar antenna elements.

A sensor device, which may advantageously be used in all four corners of the vehicle, is made available in this way because an emission characteristic or a directional characteristic may be defined relative to the motor vehicle by a corresponding arrangement of the sensor device. Use of the sensor device for both front corners and rear corners of the motor vehicle is therefore possible. Efficient and inexpensive production of the sensor device is advantageously supported in this way.

According to a second aspect, the object may be achieved by a method for manufacturing an antenna device, including the steps:

- situating a defined number of planar antenna elements of a first transmitting antenna on a substrate, the first transmitting antenna being designed to have a narrow lobe-type directional characteristic;
- situating a defined number of planar antenna elements of a second transmitting antenna on the substrate, the second transmitting antenna being designed to have a wide lobe-type directional characteristic, the transmitting antennas being designed in such a way that the directional characteristics of the two transmitting antennas are oriented opposite one another by a defined angle, with respect to a boresight; and
- situating a defined number of planar antenna elements of at least one receiving antenna on the substrate.

One advantageous refinement of a sensor device also has a plug element for connecting a plug for the antennas, the plug element being situated orthogonally to the substrate and orthogonally to the antenna elements, the plug element having the greatest distance from the receiving antenna, with respect to the antennas. In this way, the feed to the antennas on the sensor device may be implemented in a simple way. Furthermore, this permits use of the sensor device in all four corners of a vehicle in a simple way by installing the sensor device in the vehicle with a suitable alignment.

Another advantageous refinement of the sensor device provides that the narrow lobe-type directional characteristic of the first transmitting antenna has a maximum range from approximately 120 m to approximately 140 m and lateral extents to a boresight of approximately 20 m. Favorable emission properties for the narrow bundling first transmitting antenna are thus made available in this way.

Another advantageous refinement of the sensor device provides that the wide lobe-type directional characteristic of the second transmitting antenna has a maximum range from approximately 70 m to approximately 90 m and lateral extents to a boresight of approximately 40 m. Favorable emission properties are made available for the widely bundling second transmitting antenna.

The present invention is described in detail below with additional features and advantages on the basis of multiple figures. The figures are to be understood more as qualitative and not absolutely drawn to scale. The same elements or those having the same function also have the same reference numerals.

DETAILED DESCRIPTION OF EXAMPLE EMBODIMENTS

Figure 1:
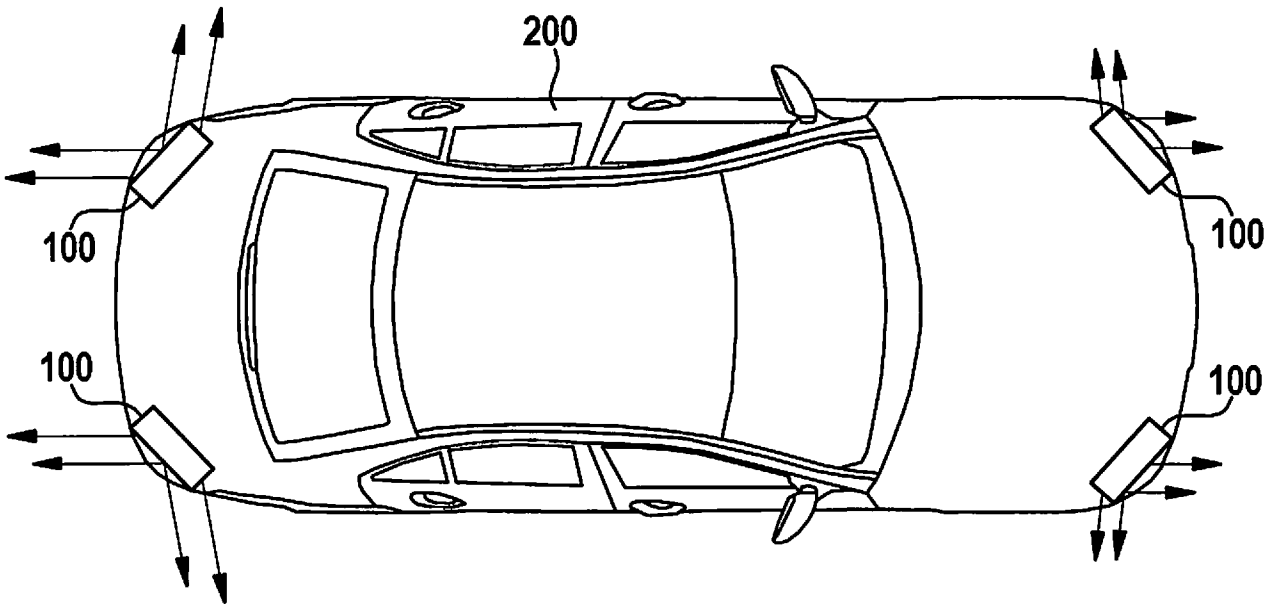
FIG. 1 shows installation positions of radar sensors in a motor vehicle.

FIG. 1 shows, in a top view, a motor vehicle 200 including multiple sensor devices 100, each sensor device 100 being situated in one of the four outer corners of the motor vehicle. A forward-sensing front sensor device is not shown. Sensor devices 100 are designed as radar sensors and are provided to focus a transmission/receiving power from transmitting antennas TX and receiving antennas RX, where defined sensing ranges are implemented in a defined field of view.

All antennas TX, RX have a defined number of rectangular or square planar antenna elements 12, which are situated on a substrate 10 (not shown) and implement generally conventional "patch antennas" in this way.

Figure 2:
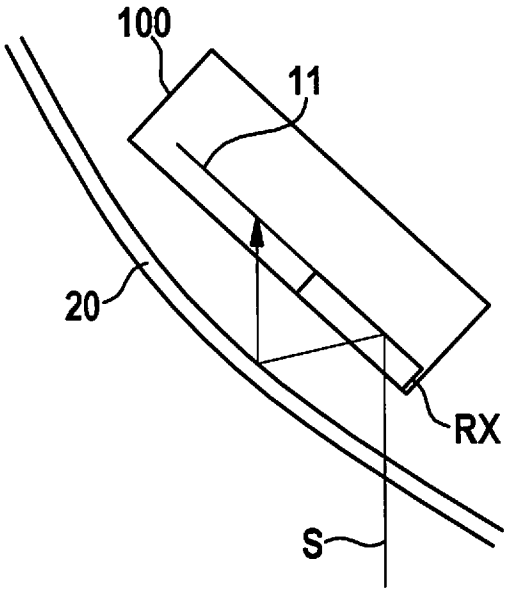

FIG. 2 schematically shows a traditional sensor device 100 installed behind a bumper 20 in a left rear corner of motor vehicle 200. It is apparent that a reception beam S coming in externally initially strikes receiving antenna RX. In a further sequence, reflections of reception beam S occur between a ground plane 11 and bumper 20 of motor vehicle 200.

Figure 3:
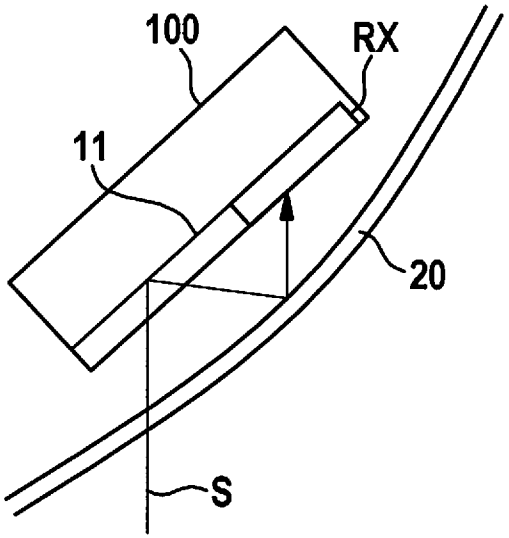
FIGS. 2 and 3 show schematic views of two rear radar sensors in a motor vehicle.

In contrast thereto, in FIG. 3, which shows a sensor device 100 installed behind a bumper 20 in a right outer corner of the vehicle, it is apparent that reception beam S with the useful signal initially strikes ground plane 11 of the high-frequency antenna layers and thereafter, in a further sequence, is subjected to multiple reflections between ground plane 11 and bumper 20. As a result, interferences may be received by receiving antenna RX, whereby the reception quality of receiving antenna RX may be worsened considerably.

A plug position (not shown) for connecting a plug for supply of signals for the antennas is situated on the bottom side of sensor device 100. For the case illustrated here, this may result in a drastic degradation of performance of receiving antenna RX for certain angles of incidence of reception beam S. The reflections have different effects for the two positions of sensor device 100. In addition to the desired path, there is thus a second path for sensor device 100 in FIG. 3, which also lands on receiving antenna RX via multiple reflections. An angle error may occur in this way due to interference with a useful signal.

A sensor device 100 is proposed, including a combination of a strongly bundling first transmitting antenna TX1, a weakly bundling second transmitting antenna TX2 and at least one receiving antenna RX1 . . . RX4.

Figure 4:
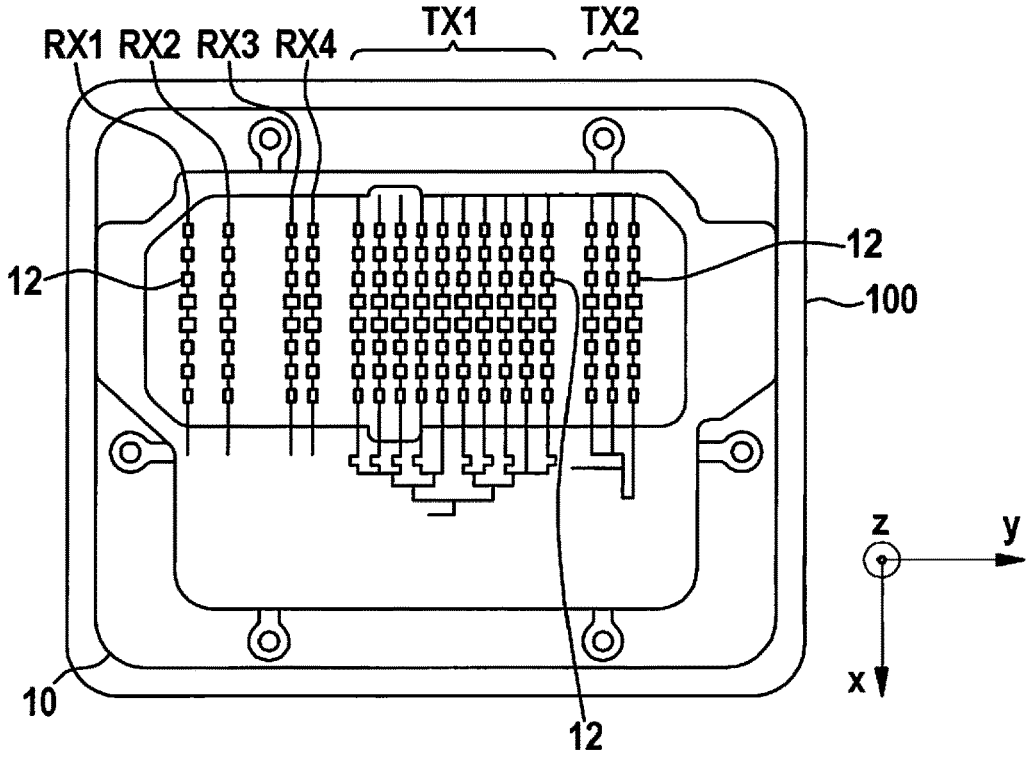
FIG. 4 shows a specific embodiment of a sensor device according to the present invention.

FIG. 4 shows a view of one specific embodiment of a sensor device 100. Apparent are first transmitting antenna TX1 having a narrow directional characteristic or bundling characteristic, including a plurality of planar antenna elements 12 and a second transmitting antenna TX2 having a wide directional characteristic or bundling characteristic, which also has a plurality of planar antenna elements 12 situated on substrate 10. First transmitting antenna TX1 has a boresight of approximately −40°, with respect to a z axis of the illustrated Cartesian coordinate system. Second transmitting antenna TX2 has a boresight of approximately 20° with respect to the z axis of the illustrated coordinate system.

Sensor device 100 also includes four receiving antennas RX1 . . . RX4, each also being implemented by planar antenna elements 12, which are situated on substrate 10.

Planar antenna elements 12 of first transmitting antenna TX1 and receiving antennas RX1 . . . RX4 are designed as conventional planar antenna elements, whose maximum emission is oriented orthogonally to substrate 10.

Due to the combination of two transmitting antennas TX1 and TX2 having different directional characteristics, sensor device 100 may be installed and used in all four outer corners of the vehicle, whereby a desired directional characteristic or emission characteristic may be achieved through a simple adapted installation position of sensor device 100. A better quality of the reception signal with less ambient noise is also supported due to the narrow bundling characteristic of first transmitting antenna TX1.

Figure 5:
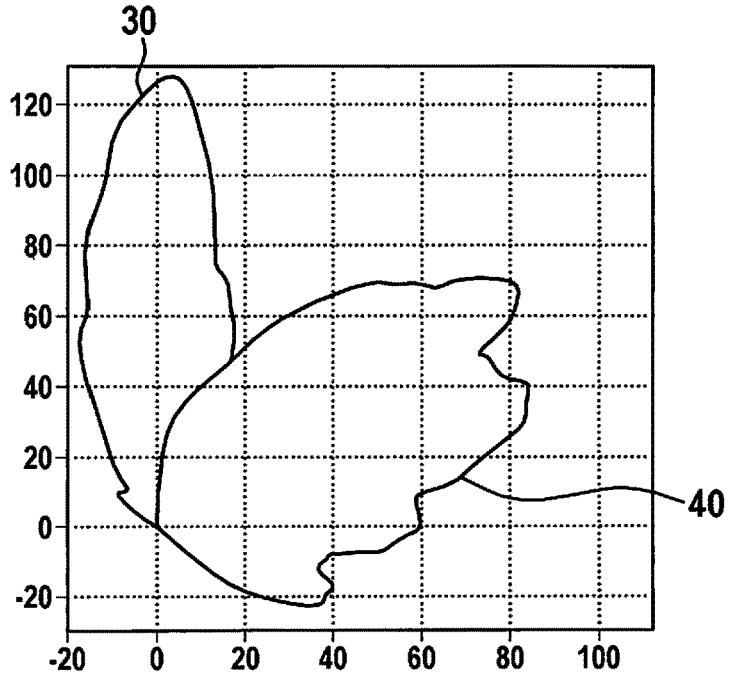
FIG. 5 shows an emission characteristic of the sensor device according to the present invention.

FIG. 5 shows in principle a directional characteristic or an emission characteristic or a bundling characteristic of two transmitting antennas TX1, TX2 of sensor device 100, having two lobes 30, 40. First lobe 30 originates from first transmitting antenna TX1 and has a narrow directional characteristic. The narrow directional characteristic may preferably have a maximum range of first lobe 30 from approximately 120 m to approximately 140 m. In comparison with FIG. 4, the Cartesian coordinate system in FIG. 5 is rotated by approximately 40° with respect to the z axis, so that lobe 30 from FIG. 5 is oriented by approximately −40° with respect to the z axis of the coordinate system from FIG. 4. Lateral dimensions of first lobe 30, with respect to a boresight, amount to approximately ±20 m.

Furthermore, a second lobe 40 which originates from second transmitting antenna TX2 is also apparent in FIG. 5. It is apparent that second lobe 40 has a wider directional characteristic in comparison with first lobe 30. Second lobe 40 is oriented in the direction of 20° with respect to the z axis of the coordinate system in FIG. 4. A maximum range of second lobe 40 preferably amounts to approximately 70 m to approximately 90 m, lateral dimensions of second lobe 40 amounting to preferably approximately ±40 m, with respect to a boresight.

Figure 7:
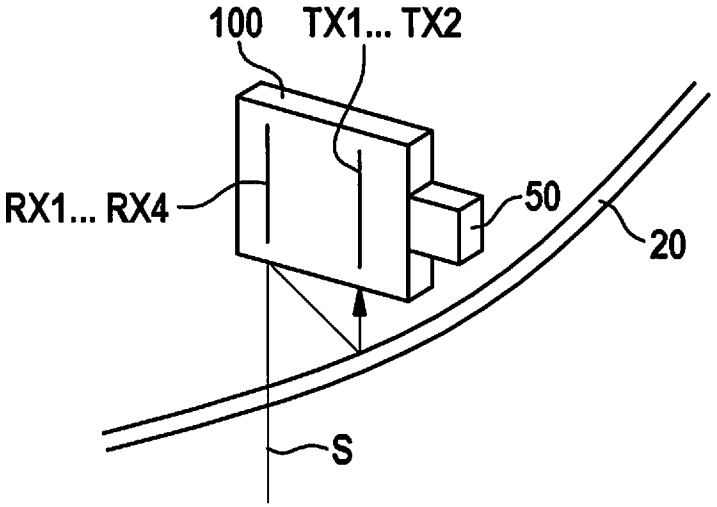
FIGS. 6 and 7 show perspective views of two rear sensor devices in a motor vehicle.
Figure 6:
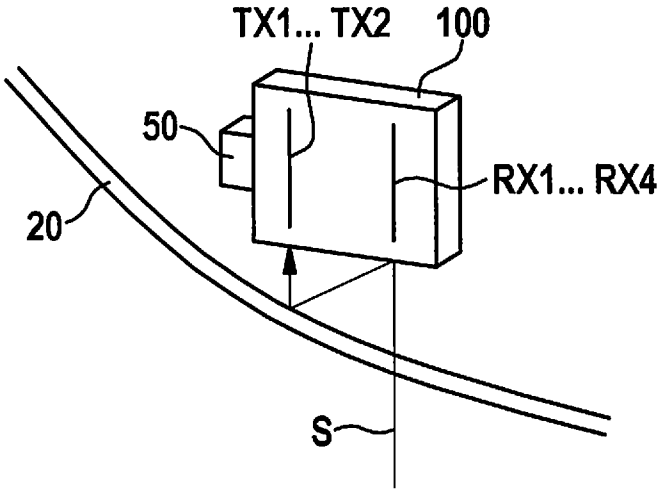

FIGS. 6 and 7 show an advantageous refinement of sensor device 100 situated in the different outer corners of motor vehicle 200. A plug element 50 which is situated laterally at sensor device 100 is apparent.

Plug element 50 is situated orthogonally to substrate 10 and orthogonally to antenna elements 12. Plug element 50 is situated at the farthest distance away from receiving antennas RX1 . . . RX4, with respect to the group of transmitting and receiving antennas TX1, TX2, RX1 . . . RX4. It is thus possible to achieve the result that reception beam S always strikes receiving antenna RX1 . . . RX4 first and is then reflected between sensor device 100 and bumper 20.

FIG. 7 shows an installed position in the right corner of the motor vehicle, the arrangement from FIG. 7 being rotated by 180° in comparison with the arrangement from FIG. 6. In this way, reflections between bumper 20 and ground plane 11 on receiving antenna RX are advantageously prevented, regardless of the receiving direction. As a result, incident reception beam S is first reflected on the antenna surface of transmitting antennas TX, whereby a reduction in the angle error is achievable.

Figure 8:
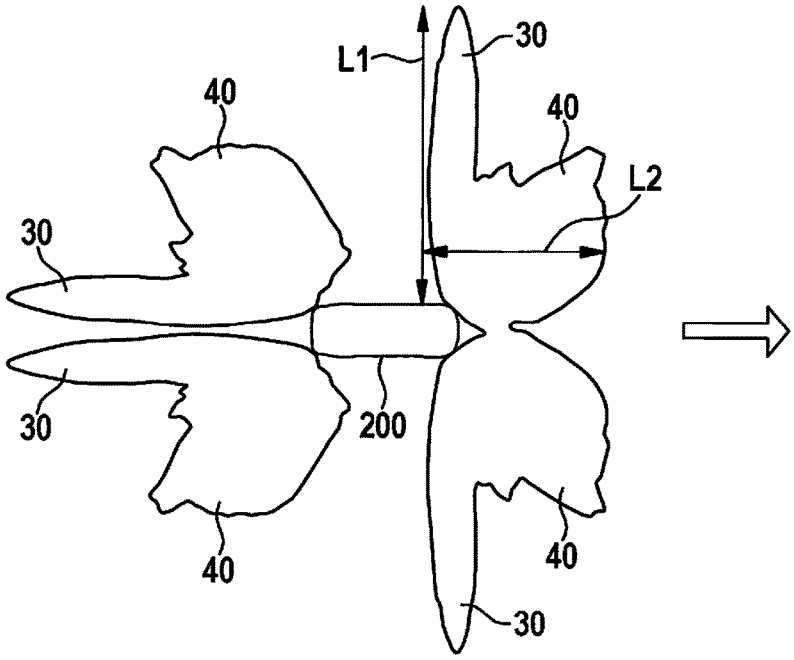
FIG. 8 shows an example of a positioning field of four sensor devices according to the present invention.

FIG. 8 shows an exemplary representation of a positioning field of a total of four sensor devices 100 in corner positions of a motor vehicle 200. A forward-driving direction of motor vehicle 200 is indicated with an arrow. It is apparent that the emission characteristics of "wide" lobes 40 are oriented forward for two front sensor devices 100, two "narrow" lobes 30 being oriented toward the side. For rear sensor devices 100, narrow lobes 30 are oriented toward the rear, whereas two lobes 40 are oriented toward the side.

The aforementioned characteristics may be modified by simply installing sensor devices 100 having a 180° rotation. Maximum range L1 of lobe 30 and maximum range L2 of second lobe 40 are indicated.

Figure 9:
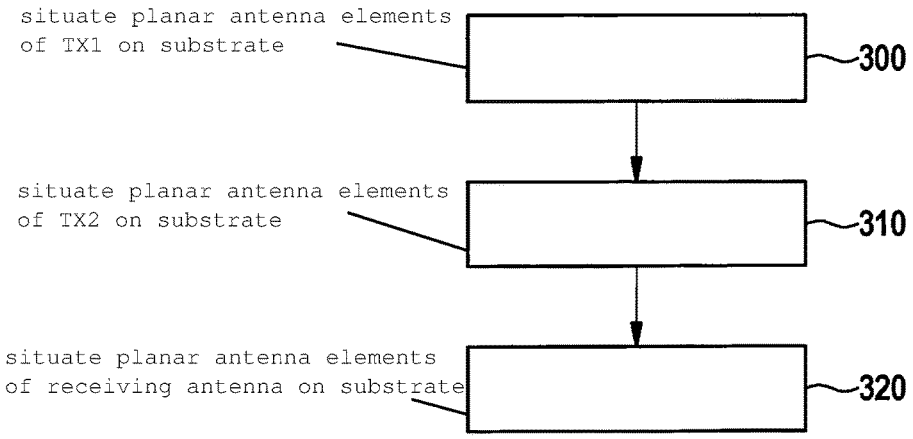
FIG. 9 shows a basic flow chart of one specific embodiment of the method according to the present invention.

FIG. 9 schematically shows a basic flow chart for the specific embodiment of the method for manufacturing a sensor device for a motor vehicle.

In a step 300, a defined number of planar antenna elements 12 of a first transmitting antenna TX1 is situated on a substrate 10, first transmitting antenna TX1 being designed to have a narrow lobe-type directional characteristic.

In a step 310, a defined number of planar antenna elements 12 of a second transmitting antenna TX2 is situated on substrate 10, second transmitting antenna TX2 being designed to have a wide lobe-type directional characteristic, the transmitting antennas being designed in such a way that the directional characteristics of two transmitting antennas TX1, TX2 are oriented opposite one another by a defined angle, with respect to a boresight.

Finally, in a step 320, planar antenna elements 12 of at least one receiving antenna RX1 . . . RX4 are situated on the substrate.

As a result, it is quite possible to use radar sensor devices having optimized sensor characteristics in all four corners of a vehicle using a single type of sensor. This makes it possible to substantially reduce the costs of production, logistics and installation, thereby supporting an efficient production of the sensor device.

In summary, a sensor device and a method for manufacturing a sensor device for a motor vehicle are proposed by the present invention, so that a robust and inexpensive radar sensor, which is simple to produce and efficient to use and has a bundling characteristic, which is easy to adjust, may be implemented. This is achieved by a combination of a transmitting antenna having a narrow bundling characteristic and a transmitting antenna having a wide bundling characteristic on the sensor device.

Although the present invention has been described primarily on the basis of concrete specific embodiments, it is by no means limited to them. Thus, in the present case, those skilled in the art will also implement other specific embodiments without departing from the core of the present invention.

What is claimed is:

1. A sensor device for a motor vehicle having a bumper, comprising:

a sensor arrangement, including:

a first transmitting antenna which is situated on a surface of a substrate and has a narrow lobe-type directional characteristic and includes a defined number of planar antenna elements;

a second transmitting antenna which is situated on the surface of the substrate and has a wide lobe-type directional characteristic, including a defined number of planar antenna elements, the directional characteristics of the first transmitting antenna and the second transmitting antenna being oriented opposite to one another by a defined angle, with respect to a boresight;

at least one receiving antenna situated on the surface of the substrate and having a defined number of planar antenna elements; and a plug element situated orthogonally to the substrate and orthogonally to the planar antenna elements, wherein the plug element of the sensor arrangement is situated at the farthest distance away from the at least one receiving antenna with respect to a group of the at least one receiving antenna and the transmitting antennas, so that an incident reception beam strikes the at least one receiving antenna first and is then reflected between the sensor arrangement and the bumper of the motor vehicle.

2. The sensor device as recited in claim 1, wherein the narrow lobe-type directional characteristic of the first transmitting antenna has a maximum range of approximately 120 m to approximately 140 m and lateral extents to a boresight of approximately ±20 m.

3. The sensor device as recited in claim 1, wherein the wide lobe-type directional characteristic of the second transmitting antenna has a maximum range of approximately 70 m to approximately 90 m and lateral extents to a boresight of approximately ±40 m.

4. A sensor device for a motor vehicle having a bumper, comprising:

a sensor arrangement, including:

a first transmitting antenna which is situated on a surface of a substrate and has a narrow lobe-type directional characteristic and includes a defined number of planar antenna elements;

a second transmitting antenna which is situated on the surface of the substrate and has a wide lobe-type directional characteristic, including a defined number of planar antenna elements, the directional characteristics of the first transmitting antenna and the second transmitting antenna being oriented opposite to one another by a defined angle, with respect to a boresight;

at least one receiving antenna situated on the surface of the substrate and having a defined number of planar antenna elements; and a plug element situated orthogonally to the substrate and orthogonally to the planar antenna elements, wherein the plug element of the sensor arrangement is rotated by 180° , so that reflections between the bumper and a ground plane on the at least one receiving antenna are prevented, regardless of a receiving direction, so that the incident reception beam is first reflected on an antenna surface of the transmitting antennas, so as to provide a reduction in an angle error.

5. The sensor device as recited in claim 4, wherein the narrow lobe-type directional characteristic of the first transmitting antenna has a maximum range of approximately 120 m to approximately 140 m and lateral extents to a boresight of approximately ±20 m.

6. The sensor device as recited in claim 4, wherein the wide lobe-type directional characteristic of the second transmitting antenna has a maximum range of approximately 70 m to approximately 90 m and lateral extents to a boresight of approximately ±40 m.

7. A method for manufacturing a sensor device for a motor vehicle having a bumper, the method comprising:

situating a defined number of planar antenna elements of a first transmitting antenna on a substrate, wherein the first transmitting antenna is formed with a narrow lobe-type directional characteristic;

situating a defined number of planar antenna elements of a second transmitting antenna on the substrate, the second transmitting antenna being configured to have a wide lobe-type directional characteristic, wherein the first transmitting antenna and the second transmitting antenna are configured so that the directional characteristics of the two transmitting antennas are oriented opposite one another at a defined angle with respect to a boresight;

situating a defined number of planar antenna elements of at least one receiving antenna on the substrate; and providing a plug element that is situated orthogonally to the substrate and orthogonally to the planar antenna elements, wherein the plug element of the sensor device is situated at the farthest distance away from the at least one receiving antenna with respect to a group of the at least one receiving antenna and the transmitting antennas, so that an incident reception beam strikes the at least one receiving antenna first and is then reflected between the sensor device and the bumper of the motor vehicle.

8. The method as recited in claim 7, wherein the narrow lobe-type directional characteristic of the first transmitting antenna is configured to have a maximum range of approximately 120 m to approximately 140 m and lateral extents to boresight of approximately ±20 m.

9. The method as recited in claim 7, wherein the wide lobe-type directional characteristic of the second transmitting antenna is configured to have a maximum range of approximately 70 m to approximately 90 m and lateral extents to a boresight of approximately ±40 m.

10. A method for manufacturing a sensor device for a motor vehicle having a bumper, the method comprising:

situating a defined number of planar antenna elements of a first transmitting antenna on a substrate, wherein the first transmitting antenna is formed with a narrow lobe-type directional characteristic;

situating a defined number of planar antenna elements of a second transmitting antenna on the substrate, the second transmitting antenna being configured to have a wide lobe-type directional characteristic, wherein the first transmitting antenna and the second transmitting antenna are configured so that the directional characteristics of the two transmitting antennas are oriented opposite one another at a defined angle with respect to a boresight;

situating a defined number of planar antenna elements of at least one receiving antenna on the substrate; and providing a plug element that is situated orthogonally to the substrate and orthogonally to the planar antenna elements, wherein the plug element of the sensor device is rotated by 180°, so that reflections between the bumper and a ground plane on the at least one receiving antenna are prevented, regardless of a receiving direction, so that the incident reception beam is first reflected on an antenna surface of the transmitting antennas, so as to provide a reduction in an angle error.

11. The method as recited in claim 10, wherein the narrow lobe-type directional characteristic of the first transmitting antenna is configured to have a maximum range of approximately 120 m to approximately 140 m and lateral extents to boresight of approximately ±20 m.

12. The method as recited in claim 10, wherein the wide lobe-type directional characteristic of the second transmitting antenna is configured to have a maximum range of approximately 70 m to approximately 90 m and lateral extents to a boresight of approximately ±40 m.

13. A motor vehicle having a bumper, comprising:

a sensor device, including:

a first transmitting antenna which is situated on a surface of a substrate and has a narrow lobe-type directional characteristic and includes a defined number of planar antenna elements;

a second transmitting antenna which is situated on the surface of the substrate and has a wide lobe-type directional characteristic, including a defined number of planar antenna elements, the directional characteristics of the first transmitting antenna and the second transmitting antenna being oriented opposite to one another by a defined angle, with respect to a boresight; and at least one receiving antenna situated on the surface of the substrate and having a defined number of planar antenna elements; and a plug element situated orthogonally to the substrate and orthogonally to the planar antenna elements, wherein the plug element of the sensor device is situated at the farthest distance away from the at least one receiving antenna with respect to a group of the at least one receiving antenna and the transmitting antennas, so that a reception beam strikes the at least one receiving antenna first and is then reflected between the sensor device and the bumper of the motor vehicle.

14. A motor vehicle having a bumper, comprising:

a sensor device, including:

a first transmitting antenna which is situated on a surface of a substrate and has a narrow lobe-type directional characteristic and includes a defined number of planar antenna elements;

a second transmitting antenna which is situated on the surface of the substrate and has a wide lobe-type directional characteristic, including a defined number of planar antenna elements, the directional characteristics of the first transmitting antenna and the second transmitting antenna being oriented opposite to one another by a defined angle, with respect to a boresight; and at least one receiving antenna situated on the surface of the substrate and having a defined number of planar antenna elements; and a plug element situated orthogonally to the substrate and orthogonally to the planar antenna elements, wherein the plug element of the sensor device is rotated by 180°, so that reflections between the bumper and a ground plane on the at least one receiving antenna are prevented, regardless of a receiving direction, so that the incident reception beam is first reflected on an antenna surface of the transmitting antennas, so as to provide a reduction in an angle error.

* * * * *